US006570328B1

(12) United States Patent
Steinmann

(10) Patent No.: US 6,570,328 B1
(45) Date of Patent: May 27, 2003

(54) ELECTRIC LAMP WITH FEEDTHROUGH COMPRISING A GAUZE

(75) Inventor: Maarten Walter Steinmann, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 237 days.

(21) Appl. No.: 09/656,125

(22) Filed: Sep. 6, 2000

(30) Foreign Application Priority Data

Sep. 6, 1999 (EP) ..... 99202905

(51) Int. Cl.[7] ..... H01J 17/16; H01J 61/30

(52) U.S. Cl. ..... 313/634; 313/636; 313/623; 313/25

(58) Field of Search ..... 313/634, 636, 313/625, 623, 17, 25

(56) References Cited

U.S. PATENT DOCUMENTS 1,957,255 A * 5/1934 Freedman ..... 313/163
2,007,941 A * 7/1935 Braselton ..... 315/46
2,295,694 A * 9/1942 Slack et al. ..... 313/561
3,450,924 A * 6/1969 Knochel et al. ..... 313/625
3,604,972 A * 9/1971 Levy ..... 313/552
5,406,165 A * 4/1995 Pragt ..... 313/25

FOREIGN PATENT DOCUMENTS

GB 496679 6/1937
GB 2045741 A 11/1980 ..... H01J/61/36
JP 03071549 A * 3/1991

* cited by examiner

*Primary Examiner*—Vip Patel
*Assistant Examiner*—Kevin Quarterman
(74) *Attorney, Agent, or Firm*—Frank Keegan

(57) ABSTRACT

The electric lamp comprises a lamp vessel (1) and an electric element (4). The electric element (4) is electrically connected to the outside via a current feedthrough (8) which comprises a molybdenum gauze as a metal sealing part (6). The risks of too strong oxidation of the metal sealing part and of excessive tensile stresses in the seal are both decreased when the molybdenum gauze (6) is used, hence the safety of the lamp is increased.

6 Claims, 1 Drawing Sheet

ELECTRIC LAMP WITH FEEDTHROUGH COMPRISING A GAUZE

BACKGROUND OF THE INVENTION

The invention relates to an electric lamp comprising:

a lamp vessel closed in a gastight manner and having a quartz glass wall enclosing a space in which an electric element is arranged;

a feedthrough comprising:

a foil-type metal sealing part completely embedded in the wall of the lamp vessel so as to form a gastight seal with the quartz glass wall, an inner current conductor connected to the metal sealing part, extending into the space, and connected to the electric element;

an outer current conductor connected to the metal sealing part at a connection area and extending through the wall to the exterior.

Such a lamp is known from GB 496 679. In the known lamp the metal sealing part is a metal strip, e.g. made of molybdenum. Tensile stresses in the quartz glass wall are present owing to different coefficients of linear thermal expansion, approximately $50*10^{-7}$ $K^{-1}$ for molybdenum and approximately $6*10^{-7}$ $K^{-1}$ for quartz glass, i.e. glass having an $SiO_2$ content of at least 95% by weight, in the gastight seal between the metal strip and the quartz glass wall. Seals are stronger when these stresses are relatively low, and as a result the risk of early failure of the lamp is reduced. To lower these tensile stresses in the quartz glass, the metal strip has a special shape, i.e. is crinkled or provided with holes. High tensile stresses between the quartz glass wall and the metal strip are avoided during the manufacture of the lamp because of this shape. However, the known lamp has the disadvantage that the metal strip should extend for a substantial distance outside the quartz glass wall, both into the space and to the exterior. Since the metal strip extends into the space of the lamp vessel, the metal strip is excessively exposed to the corrosive atmosphere inside the lamp vessel. As a result there is a significant risk of corrosion of the metal strip, leading to a relatively fast blackening of the quartz glass wall involving relatively bad lumen maintenance. Since the metal strip extends to the exterior, the risk of a person unintentionally touching live electric parts is significantly increased.

Another disadvantage of the metal strip is that its manufacture involves a serious risk of fracture of the metal strip; besides, the manufacture of the metal strip is cumbersome. To obtain a good functioning of the crinkled metal strip, the crinkles are obtained by making bends in the foil through a predetermined angle. However, on the one side these bends should be as sharp as possible to lower the risk of too high stresses in the quartz glass, on the other hand these bends should be rounded to lower the risk of fracture and weakening of the metal strip owing to too sharp bends. In the case of the crinkled metal strip, furthermore, high demands are imposed on the manufacture of the gastight seal since care should be taken that the shape of the strip and in particular the shape of the sharp bends should withstand the sealing process. To obtain a metal strip with holes, openings have to be made in a strip having a completely closed surface. This may be done, for example, by punching or chemical etching. In the known lamp, the holes are made by punching. However, punching involves a mechanical load and hence the risk of fracture or at least serious weakening of the (brittle) metal strip. Hence, the manufacture of the lamp is relatively cumbersome, because special care has to be taken to avoid breakage of the weakened metal strip during the sealing process.

Yet another disadvantage of the known lamp is that corrosion and subsequent expansion of the external current conductor and/or the metal strip in the quartz glass wall relatively soon leads to high tensile stresses in the quartz glass. Since there is little room for this expansion in the quartz glass wall and since there is an abundance of oxidation-sensitive material, there is a great risk for these tensile stresses to reach a critical value and a subsequent breakage of the quartz glass. Such breakage heightens the risk of failure of the known lamp by explosion, hence the known lamp is relatively unsafe.

SUMMARY OF THE INVENTION

It is an object of the invention to supply a lamp of the type described in the opening paragraph, which has a relatively good lumen maintenance, which can be easily manufactured, and which is of a relatively safe construction.

This object is obtained according to the invention by an electric lamp of the kind described in the opening paragraph which is characterized in that the metal sealing part comprises a gauze at the connection area. In the lamp of the invention the metal sealing part does not extend from the quartz glass wall into the space of the lamp vessel. Hence, the risk of corrosion of the metal sealing part is significantly reduced and the prospect of relatively little blackening taking place, involving a good lumen maintenance, is enhanced.

Furthermore, the metal sealing part comprising the gauze is relatively robust, hence the sealing process can readily be done. Therefore the manufacture of the lamp can be relatively easy. In the manufacture of the- lamps a seal is made in which one or more of said metal sealing parts comprising gauzes are enclosed in the wall. During the manufacture, the glass is softened at the area where this seal is to be created in the presence of the metal sealing part and the external current conductor. The quartz glass then reaches a temperature of more than 1900° C. As soon as the quartz glass comes into contact with the external current conductor, this conductor becomes so hot that the quartz glass flows out over the metal sealing part and into the openings of the gauze. The molten quartz glass fuses itself substantially immediately to the metal sealing part and to the quartz glass on the other side of the openings, forming a tight bond. Subsequently, the seal thus formed is cooled down. Owing to its comparatively high coefficient of linear thermal expansion (approximately $50*10^{-7}$ $K^{-1}$), the external current conductor contracts more strongly during this cooling down than does the quartz glass (linear coefficient of thermal expansion of approximately $6*10^{-7}$ $K^{-1}$) in which it is embedded. Under these circumstances a capillary space is formed around this current conductor. It appears that no such capillary space is forming around the metal sealing part because of its foil-like shape. The areas adjacent to the areas where either the internal or the external current conductor and the metal sealing part overlap are the connection areas.

The capillary space around the external current conductor is in an open connection with the atmosphere outside the lamp, which renders the external current conductor and the gauze of the metal sealing part easily accessible to oxygen. Corrosion of the external current conductor and/or the gauze will result in an expansion, which expansion is especially critical at the connection area. The time needed for tensile stresses to reach a critical value is increased in the lamp according to the invention, because less oxidation of metal will occur because in the case of the gauze there is less material which has an open connection with the atmosphere outside the lamp in comparison with a seal construction having an ordinary or crinkled metal foil. To avoid excessive oxidation outside the connection area, it is not necessary for the metal sealing parts to have a gauze structure outside this area.

It has been found that, due to the increase in time needed for tensile stresses to reach a critical value, the risk of explosion of the lamp of the invention has become negligibly small, since the lamp is likely to fail through oxidation of the metal gauze,. Most probably this oxidation will have caused the end of the electrical contact between the external current conductor and the metal gauze before the tensile stresses could reach a critical value. Hence the lamp is relatively safe.

The capillary space around the internal current conductor is in an open connection with the space, containing a filling, inside the lamp. This capillary space renders the internal current conductor and the gauze of the metal sealing part easily accessible to the filling. It has been found that the time needed for tensile stresses to reach a critical value is increased in the connection area at the internal current conductor, too, owing to the metal gauze. Most probably oxidation of the metal gauze in the connection area at the external current conductor will have caused the end of the electrical contact between the external current conductor and the metal gauze before the tensile stresses in the connection area at the internal current conductor could reach a critical value. Hence the lamp is relatively safe.

In a further embodiment, the electric lamp according to the invention is characterized in that the metal sealing part is a gauze. This embodiment is easier to manufacture than a lamp comprising a gauze as part of the metal sealing part.

In a preferred embodiment, the electric lamp according to the invention is characterized in that the gauze consists of an element chosen from the group formed by molybdenum, rhenium, tungsten and mixtures thereof. These elements and their mixtures are known materials for use as electrical feedthroughs in quartz glass lamp vessels. It is advantageous for these elements to have a dopant in an amount of up to 10% by weight. The various properties of the gauze material are improved by these dopants. Favorably, these dopants comprise yttrium, hafnium, thorium and/or lanthanum. In tungsten, for example, the chemical adhesion of the tungsten to quartz glass is improved by these dopants, so the gastightness of the seal is improved. Furthermore; yttrium and lanthanum improve the ductility of, for example, recrystallized molybdenum, and as a result the tensile stresses in the lamp at the seal are further reduced thereby, which further improves the safety of the lamp.

In another preferred embodiment, the electric lamp according to the invention is characterized in that the gauze is made of wires having diameters $\phi$ of 20 $\mu$m$\leqq\phi\leqq$100 $\mu$m, preferably 30 $\mu$m$\leqq\phi\leqq$60 $\mu$m. To obtain a gastight seal, every single wire of the metal gauze has to be gastightly embedded in the quartz glass wall. By limiting the maximum diameter of the single wires to 100 $\mu$m, the tensile stresses in the quartz glass caused by the different thermal expansions of the quartz glass and the metal of the metal gauze will be relatively low. Then also the formation of capillaries around the single wires is avoided; thus the gastight bond between the quartz glass and the single wires of the metal gauze is maintained. To preserve the structure of the metal gauze and to give it sufficient strength, the respective single wires of the metal gauze should have a minimum diameter of 20 $\mu$m. Especially good results were obtained with lamps having metal gauzes made of single wires having diameters in a range of 30–60 $\mu$m. The metal gauzes could be handled easily without substantial risk of damaging the gauzes, and the tensile stresses in the quartz glass wall due to the embedded metal gauzes were relatively low.

The metal gauze is a woven structure of parallel wires. Consecutive parallel wires are spaced apart by a wire distance. To enable the quartz glass to flow easily through the openings in the gauze, despite the relatively high viscosity of the quartz glass during the sealing process, the wire distance should be at least three times the diameter of the wire.

A lamp is known from GB 2,045,741 which has a molybdenum foil as the metal sealing part. The known lamp is protected against corrosion in that prior to its manufacture a coating, for example with chromium, is provided on the molybdenum foil. However, the manufacture of the coated molybdenum foils is cumbersome and expensive. Moreover, coated molybdenum foils impose extra demands on the manufacture of the lamp since there is an increased risk of contamination of the filling of the lamp by the coating.

BRIEF DESCRIPTION OF THE DRAWINGS

Embodiments of the high-pressure discharge lamp of the invention are diagrammatically shown in the drawing, in which.

DETAILED DESCRIPTION OF THE PREFERRED EMBODIMENTS

Figure 1:
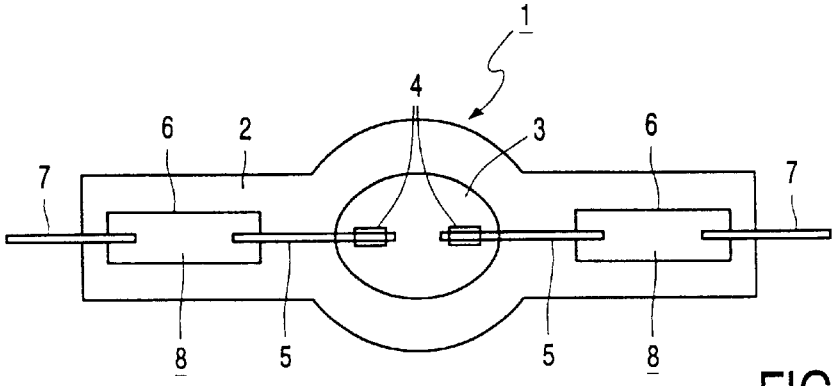
FIG. 1 is an elevation of a lamp.

In FIG. 1, the electric lamp is a high-pressure gas discharge lamp having a lamp vessel 1 which is closed in a gastight manner and which has a quartz glass wall 2 enclosing a space 3. An electric current 4 is connected via internal current conductors 5 to respective feedthroughs 8 comprising metal gauzes 6, in FIG. 1 of W with 0.5% by weight of $La_2O_3$. The electric element 4 is a pair of electrodes in FIG. 1, but it could alternatively be an incandescent body. The internal current conductors 5 project from the wall 2 of the lamp vessel 1 into the space 3. The metal gauzes 6 are embedded in the wall 2 of the lamp vessel 1 and connected, for example, welded, to respective external current conductors 7, of Mo in FIG. 1.

The internal current conductors 5 and the electric element 4 are made of tungsten and may have a small amount of crystal growth of tungsten-regulating means such as 0.01% by weight in total of K, Al and Si, and as an additive 1.5% by weight of $ThO_2$. An ionizable filling is present in the space 3. In FIG. 1, the lamp vessel I is filled with mercury, rare gas and halides of dysprosium, holmium, gadolinium, neodymium and cesium. The lamp shown in FIG. 1 consumes a power of 400 W during stable operation. Under atmospheric circumstances, the lamp may operate without an outer envelope and still have so little corrosion of the metal gauzes 6 and the external current conductor 7 that the lamp does not fail by explosion.

Figure 2A:
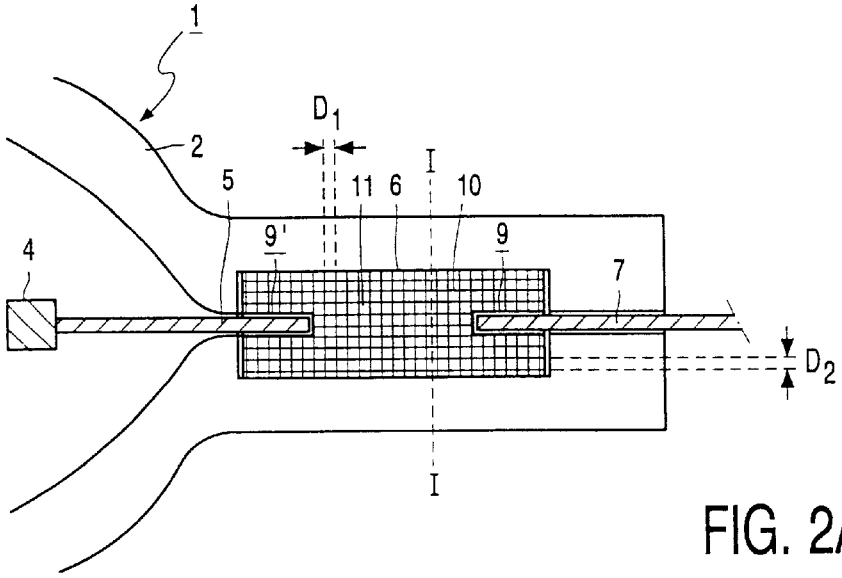
FIG. 2*a* a detail of the seal of the lamp of FIG. 1.
Figure 2B:
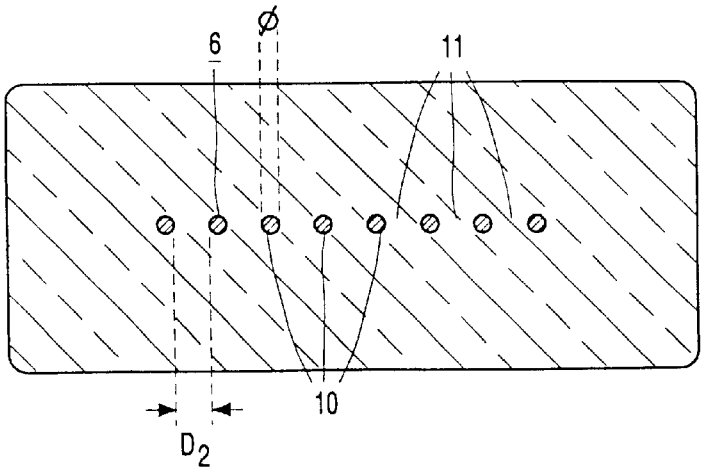
FIG. 2*b* a cross-section taken on the line I—I of a seal of the lamp of FIG. 1.

FIG. 2*a* diagrammatically shows schematically a detail of the seal of the lamp of FIG. 1. A metal gauze 6 is embedded in the quartz glass wall 2 of the lamp vessel 1. The metal gauze 6 and an external current conductor 7 overlap in a connection area 9, the metal gauze 6 and an internal current conductor 5 overlap in a connection area 9'. The wires 10 of the metal gauze 6 are spaced apart in one direction with a wire distance D1 and in a transverse direction with a wire distance D2, resulting in an opening 11. D1 and D2 are both 120 $\mu$m. In FIG. 2A, the wire distances D1 and D2 are the sane, but alternatively these distances may be different. As is shown diagrammatically in FIG. 2*b*, the metal gauze is a woven structure of parallel wires 10 having a diameter $\phi$ of 35 $\mu$m. The wire distance D2 between consequently parallel wires 10 is more than three times the diameter $\phi$, enabling the flow of quartz glass on both sides of the openings 11 through these openings 11 and a mutual fusing of both sides. The quartz glass has also fused itself to the wires 10 of the metal gauze 6, without a capillary being formed; thus the gastight seal is obtained.

What is claimed is:

1. An electric lamp comprising:

a lamp vessel (1) closed in a gastight manner and having a quartz glass wall (2) enclosing a space (3) in which an electric element (4) is arranged;

a feedthrough (8) comprising:

a metal gauze (6), said gauze (6) comprised of a woven structure of parallel wires completely embedded in the wall (2) of the lamp vessel (1) wherein each of said wires has a maximum diameter of 100 $\mu$m so as to form a gastight seal with the quartz glass wall (2) thus avoiding the formation of capillaries therebetween;

an inner current conductor (5) connected to the gauze (6) at a first connection area (9'), said inner current conductor (5), extending into the space (3), and connected to the electric element (4);

an outer current conductor (7) having at least a portion thereof dimensioned and configured for mating with at least a portion of the gauze (6) at a second connection area (9), the outer current conductor (7) extending through the wall (2) to the exterior.

2. An electric lamp as claimed in claim 1, wherein the gauze (6) consists of an element chosen from the group formed by molybdenum, rhenium, tungsten and mixtures thereof.

3. An electric lamp as claimed in claim 2, wherein the element contains a dopant, accounting for up to 10% by weight.

4. An electric lamp as claimed in claim 3, wherein the dopant is chosen from the group formed by yttrium, lanthanum, hafnium, and thorium.

5. An electric lamp as claimed in claim 1, wherein the gauze (6) is made of wires (10) having diameters $\phi$ of 20 $\mu m \leqq \phi \leqq 100$ $\mu$m, preferably 30 $\mu m \leqq \phi \leqq 60$ $\mu$m.

6. An electric lamp as claimed in claim 5, wherein consecutive parallel wires (10) of the gauze (6) are spaced apart with a wire-distance (D1, D2), for which it is true that said wire-distance is $\geqq$b 3*$\phi$.

* * * * *